US007501390B2

(12) United States Patent
Yagi et al.

(10) Patent No.: US 7,501,390 B2
(45) Date of Patent: Mar. 10, 2009

(54) CONCENTRATED NEUTRAL DETERGENT COMPOSITION COMPRISING AN ALKANESULFONIC ACID SALT, A POLYOXYALKYLENE ALKYLE ETHER, AN ALKYL POLYGLUCOSIDE, AND WATER

(75) Inventors: Mari Yagi, Tokyo (JP); Mitsou Sado, Yokohama (JP); Aki Inageta, Tokyo (JP)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 10/592,177

(22) PCT Filed: Mar. 2, 2005

(86) PCT No.: PCT/US2005/006762

§ 371 (c)(1),
(2), (4) Date: Jun. 15, 2007

(87) PCT Pub. No.: WO2005/093028

PCT Pub. Date: Oct. 6, 2005

(65) Prior Publication Data

US 2007/0287649 A1 Dec. 13, 2007

(30) Foreign Application Priority Data

Mar. 9, 2004 (JP) ..... 2004-065286

(51) Int. Cl.

| | |
|---|---|
| ***C11D 1/12*** | (2006.01) |
| ***C11D 1/72*** | (2006.01) |
| ***C11D 1/90*** | (2006.01) |
| ***C11D 3/22*** | (2006.01) |

(52) U.S. Cl. ..... 510/474; 510/197; 510/199; 510/235; 510/421; 510/426; 510/433; 510/495; 510/499; 510/535

(58) Field of Classification Search ..... 510/197, 510/199, 235, 421, 426, 433, 474, 495, 499, 510/535

See application file for complete search history.

(56) References Cited

U.S. PATENT DOCUMENTS 5,767,051 A * 6/1998 Drapier et al. ..... 510/235

FOREIGN PATENT DOCUMENTS

WO WO 98/05743 * 2/1998

* cited by examiner

*Primary Examiner*—Brian P Mruk
(74) *Attorney, Agent, or Firm*—Gregory S. Bollis

(57) ABSTRACT

The present invention provides a concentrated neutral liquid detergent composition for hard surfaces, which has excellent detergency and foaming property, excellent stability in storage, and excellent ability to prevent repeated adhesion of contaminants to the washed surface, the composition being advantageously suitable for manual washing of tableware and cooking utensils. A concentrated neutral detergent composition for hard surfaces, comprising (A) 0.1 to 14 wt % of an alkanesulfonic acid salt; (B) 12 to 40 wt % of a polyoxyalkylene alkyl ether; (C) 10 to 40 wt % of an alkyl polyglucoside; and (D) water.

15 Claims, No Drawings

CONCENTRATED NEUTRAL DETERGENT COMPOSITION COMPRISING AN ALKANESULFONIC ACID SALT, A POLYOXYALKYLENE ALKYLE ETHER, AN ALKYL POLYGLUCOSIDE, AND WATER

TECHNICAL FIELD

The present invention relates to a concentrated neutral detergent composition which has excellent detergency and foaming property, excellent stability in storage, and excellent ability to prevent repeated adhesion of contaminants to the washed surface, the composition being advantageously suitable for manual washing of tableware and cooking utensils.

BACKGROUND ART

Liquid detergent compositions used for manual washing of tableware and cooking utensils are generally required to have excellent detergency and good foaming property. Examples of such detergent compositions include a liquid detergent composition comprising an alkyl glucoside, a carbobetaine, an anionic surfactant having a sulfate group and/or sulfonate group, or an ethylene oxide-added nonionic surfactant at the prescribed ratios (Japanese Patent Application Laid-open No. H8-120293), a detergent composition comprising an alkyl glucoside, a surfactant having a sulfate and/or sulfonate group, a specific amine oxide, and an ethylene oxide-added nonionic surfactant at the prescribed ratio (Japanese Patent Application Laid-open No. H2-164819), and a liquid detergent composition comprising an alkyl glucoside, an anionic surfactant, and betaine and/or amine oxide at the prescribed ratio (Japanese Patent Application Laid-open No. H1-318089).

Among the concentrated neutral detergent compositions that are used as detergents for washing tableware, the compositions for business application are mainly supplied in glass jars with a capacity of 18 L or plastic containers upon adjusting the concentration of surfactant components to 10-15 wt. %. However, increased awareness of environmental load and rising cost of waste processing of containers and the requirement to reduce the space taken by the detergents have recently led to a transition to detergent containers of decreased size and concentrated detergents.

A concentrated liquid detergent composition disclosed in Japanese Patent Application Laid-open No. H6-299191 and having excellent stability in storage is an example of such concentrated detergent composition. This composition comprises an anionic surfactant having a sulfate group and/or sulfonate group, a specific polyoxyalkylene alkyl ether-type nonionic surfactant, an alkyl polysaccharide surfactant, a phase adjusting agent such as a lower alcohol, a polyethylene glycol, a polypropylene glycol, a lower alkylbenzenesulfonate, a benzoic acid salt, and urea at the prescribed ratios, wherein the content of alkyl metals and/or alkaline earth metals in the composition is not higher than the specific quantity.

If contaminants that have been removed from the washed articles such as tableware and cooking utensils and diffused in the washing liquid again adhere to the washed article in the course of subsequent washing operation, then second washing becomes necessary or excess water and time are required for rinsing, thereby degrading the efficiency and making it difficult to conduct satisfactory washing. Therefore, a performance is required such that the contaminants are emulsified in the washing liquid and do not adhere to the washed surface.

The above-mentioned publications disclosing conventional compositions described the improvement of detergency, foaming property, mildness to skin, and stability in storage, but they provided no description of the ability to prevent the repeated adhesion of contaminant that is effective for use. Accordingly, a demand was created for the development of a concentrated neutral detergent composition which has excellent stability in storage in addition to excellent detergency and foaming property and also excellent ability to prevent repeated adhesion of contaminants to the washed surface, the composition being advantageously suitable for manual washing of tableware and cooking utensils.

DISCLOSURE OF THE INVENTION

With the foregoing in view, it is an object of the present invention to provide a concentrated neutral detergent composition which has excellent stability in storage in addition to excellent detergency and foaming property and also excellent ability to prevent repeated adhesion of contaminants to the washed surface, the composition being advantageously suitable for manual washing of tableware and cooking utensils.

The inventors have conducted a comprehensive study to attain the above-described object and have found that a concentrated neutral detergent composition which has excellent stability in storage in addition to excellent detergency and foaming property and also excellent ability to prevent repeated adhesion of contaminants to the washed surface, this composition being advantageously suitable for manual washing of tableware and cooking utensils, can be obtained by combining an alkanesulfonic acid salt, a polyoxyalkylene alkyl ether, an alkyl polyglucoside, and water at the prescribed ratio.

Thus, the present invention provides:

1. A concentrated neutral detergent composition comprising:

(A) 0.1 to 14 wt % of an alkanesulfonic acid salt;

(B) 12 to 40 wt % a polyoxyalkylene alkyl ether;

(C) 10 to 40 wt % an alkyl polyglucoside; and (D) water.

2. The concentrated neutral detergent composition according to clause 1, further comprising (E) 0.1 to 10 wt % of a betaine.

3. The concentrated neutral detergent composition according to clause 1 or 2, wherein the sum total of surfactant components including the above-described (A) to (C) components as necessary components is 30 to 70 wt % based on the entire composition.

4. The concentrated neutral detergent composition according to clause 1 to 3, wherein the alkanesulfonic acid salt which is the (A) component is a secondary alkanesulfonic acid salt represented by the general formula (1) hereinbelow.

[Formula 1]

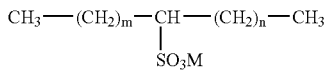

(1)

[in formula (1), M denotes a hydrogen ion, an alkali metal ion, an alkaline earth metal ion equivalent to monovalent, an ammonium ion that may be substituted, and an alkanolamine ion; m+n=7 to 17].

5. The concentrated neutral detergent composition according to clause 1 to 4, wherein the polyoxyalkylene alkyl ether that is the (B) component is a polyoxyethylene alkyl ether and/or polyoxyethylene polyoxypropylene alkyl ether.

6. The concentrated neutral detergent composition according to clauses 1 to 5 wherein the alkyl polyglucoside that is the (C) component is represented by the general formula (2) hereinbelow.

$$R^1—(OR^2)x(Z)y \quad (2)$$

[in formula (2), $R^1$ denotes a linear or branched alkyl group, alkenyl group, or alkylphenyl group with an average number of carbon atoms of 8 to 18, $R^2$ denotes an alkylene group with 2 to 4 carbon atoms, Z denotes a residue derived from a reduced sugar with 5 to 6 carbon atoms, x is a number with an average thereof being 0 to 5, y is a value with an average thereof being 1 to 2].

7. The concentrated neutral detergent composition according to clauses 2 to 6, wherein the betaine that is the (E) component is alkyldimethylaminoacetic acid betaine and/or fatty acid amidopropyl betaine.

8. The concentrated neutral detergent composition according to clauses 1 to 7, supplied for hard surface applications.

9. The concentrated neutral detergent composition according to clauses 1 to 8, supplied for tableware and cooking utensil applications.

The concentrated neutral detergent composition in accordance with the present invention demonstrates an effect of excellent detergency and foaming property and also excellent stability in storage over a wide temperature range because it contains an alkanesulfonic acid salt ((A) component), polyoxyalkylene alkyl ether ((B) component), alkyl polyglucoside ((C) component), and water ((D) component) at a specific ratio. Furthermore, this composition also exhibits excellent ability to prevent repeated adhesion of contaminants to the washed surface. The concentrated neutral detergent composition in accordance with the present invention can be advantageously used for manual washing of hard surfaces such as ceramics, porcelain, pottery, plastics, metals and glass, more particularly tableware and cooking utensils.

BEST MODE FOR CARRYING OUT THE INVENTION

The concentrated neutral detergent composition in accordance with the present invention (referred to hereinbelow as "present composition") comprises the aforementioned (A) component, (B) component, (C) component, and (D) components as necessary components.

An alkanesulfonate is used as the (A) component employed in accordance with the present invention. This (A) component is compounded with the object of improving the foaming property and ability to prevent repeated adhesion. One or combination of two or more alkanesulfonates can be used.

More specifically, the preferred (A) component is an alkanesulfonate with an average number of carbon atoms in a molecule of 10-20, more preferably 12-18. Among such compounds, from the standpoint of detergent capacity, secondary alkanesulfonates represented by the general formula (1) are preferred.

[Formula 1]

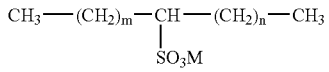

(1)

[in formula (1), M denotes a hydrogen ion, an alkali metal ion, an alkaline earth metal ion equivalent to monovalent, an ammonium ion that may be substituted, and an alkanolamine ion; m+n=7 to 17].

Specific examples of salts of the (A) component include sodium salts, potassium salts, ammonium salt, monoethanolamine salts, diethanolamine salts, and triethanolamine salts. From the standpoint of detergent capacity and availability, sodium salts are preferred.

Among the above-described (A) components, from the standpoint of detergent capacity and availability, sodium salts of secondary alkanesulfonic acids are preferred.

Further, the compounded quantity of (A) component in the present composition is set within a range of 0.1-14 wt. %. If this quantity is less than 0.1 wt. %, the improvement effect of foaming property and repeated adhesion prevention ability is poor, and when the component is compounded in excess of 14 wt. %, the improvement effect of detergency reaches saturation, stability in storage degrades, and the cost efficiency is inappropriate. From the standpoint of detergency, the range of 1-10 wt. % is preferred, and from the standpoint of foaming capacity and cost efficiency, the range of 3-8 wt. % is even more preferred.

Polyoxyalkylene alkyl ethers can be used as the (B) component employed in accordance with the present invention. This (B) component is compounded with the object of increasing the detergency, and one or combination of two or more of such components can be used.

From the standpoint of detergency the preferred polyoxyalkylene alkyl ethers as the (B) component are polyoxyethylene alkyl ether and/or polyoxyethylene polyoxypropylene alkyl ether. More specifically, the preferred component is obtained by adding an alkyl oxide to a linear- or branched-chain alcohol containing 6 to 24, preferably 8 to 16 carbon atoms. As for the alkylene oxide that is added to the alcohol, in the case of ethylene oxide adduct, the quantity thereof is 2-20 mol, preferably 2-15 mole, and in the case of the ethylene oxide and propylene oxide co-adduct, the quantity of ethylene oxide is 1-25 mole, preferably 1-10 mole, and the quantity of propylene oxide is 1-30 mole, preferably 1-10 mole.

Among the aforementioned compounds, from the standpoint of detergency and repeated adhesion prevention ability, the preferred polyoxyethylene alkyl ether is obtained by adding 4-15 mole of ethylene oxide to a linear- or branched-chain alcohol having 9 to 15 carbon atoms and the preferred polyoxyethylene polyoxypropylene alkyl ether is obtained by adding 4-15 mole of ethylene oxide and 1-5 mole of propylene oxide to a linear- or branched-chain alcohol having 9 to 15 carbon atoms.

The compounded quantity of component B in the present composition is set within a range of 12-40 wt. %. When this quantity is less than 12 wt. %, the detergency is poor, and when it exceeds 40%, the improvement effect of repeated adhesion prevention ability is poor. Moreover, stability in storage degrades and cost efficiency becomes inappropriate. With the quantity within the aforementioned range, from the standpoint of detergency and range of 15-35 wt. % is preferred, and from the standpoint of cost efficiency, a range of 15-30 wt. % is even more preferred.

An alkyl polyglucoside is used as the (C) component employed in accordance with the present invention. This (C) component is compounded with the object of improving detergency, foaming property, and repeated adhesion prevention ability. Furthermore, it also has an effect of alleviating the irritation of skin. One compound (C) or combination of two or more thereof can be used.

The alkyl polyglucoside of the (C) component is represented by the following general formula (2)

$$R^1—(OR^2)_x(Z)_y \quad (2)$$

[in formula (2), $R^1$ stands for a linear- or branched-chain alkyl group, alkenyl group, or alkylphenyl group with an average number of carbon atoms of 8 to 18, $R^2$ stands for an alkylene group containing 2 to 4 carbon atoms, Z is a residue derived from reduced sugar having 5 to 6 carbon atoms, x is a number with an average value of 0 to 5, and y is a number with an average value of 1 to 2].

From the standpoints of solubility in water and detergency, $R^1$ is preferably an alkyl group with an average number of carbon atoms of 8 to 14. From the standpoint of solubility in water, $R^2$, preferably has 2 to 3 carbon atoms. Furthermore, the structure of Z is determined by starting materials of monosaccharides, disaccharides of higher saccharides. From the standpoint of availability and cost, the preferred monosaccharides are glucose and fructose and the preferred disaccharides of higher saccharides are maltose and sucrose. Among them, from the standpoint of availability, glucose is preferred.

The compounded quantity of (C) component in the composition is set within a range of 10-40 wt. %. When this quantity is less than 10 wt. %, the improvement effect of foaming property and repeated adhesion prevention ability is poor. Further, when this quantity exceeds 40 wt. %, the improvement effect of foaming capacity and detergency reaches saturation due to balance with other components and cost efficiency becomes inappropriate. From the standpoint of detergency a range of 15-40 wt. % is preferred, and from the standpoint of stability in storage, a range of 15-35 wt. % is even more preferred.

Pure water, ion exchange water, soft water, distilled water, or tap water can be used as the water which is the (D) component used in accordance with the present invention. Those can be used individually or in combination of two or more thereof. From the standpoints of cost efficiency and stability in storage, water and ion exchange water are preferred.

The term "water" used hereinabove relates to a sum of water contained in the form of aqueous solution or water of crystallization that is derived from the components constituting the concentrated neutral detergent composition in accordance with the present invention and water added from the outside. This sum is compounded at 100% of the entire composition.

In the concentrated neutral detergent composition in accordance with the present invention, betaine can be contained as the (E) component with the object of increasing the ability to prevent the repeated adhesion of contamination to the washed surface.

Examples of betaine of the (E) component used in accordance with the present invention include alkyldimethylaminoacetic acid betaines, fatty acid amidopropyl betaines, alkyldihydroxymethyl betaines, alkyldihydxyethyl betaines, imidazolinium betaines, and alkylsulfobetaines. Those betaines may be used individually or in combination of two or more thereof.

More specifically, examples of the aforementioned alkyldimethylaminoacetic acid betaines include octyldimethylaminoacetic acid betaine, palmityldimethylaminoacetic acid betaine,stearyldimethylaminoacetic acid betaine, lauryldimethylaminoacetic acid betaine, coconut oil alkyldimethylaminoacetic acid betaines, decyldimethylaminoacetic acid betaine, myristyldimethylaminoacetic acid betaine, and 2-ethylhexyldimethylaminoacetic acid betaine.

Examples of the aforementioned fatty acid amidopropyl betaines include lauric acid amidopropyl betaine, coconut oil fatty acid amidopropyl betaines, decanoic acid amidopropyl betaine, myristic acid amidopropyl betaine, and 2-ethylhexanoic acid amidopropyl betaine.

Examples of the aforementioned alkyldihydroxymethyl betaines include lauryldihydroxymethyl betaine and coconut oil alkyldihydroxymethyl betaines.

Examples of the aforementioned alkyldihydxyethyl betaines include lauryldihydroxyethyl betaine and coconut oil alkyldihydroxyethyl betaines.

Examples of the aforementioned imidazolinium betaines include 2-alkyl ($C_{6-22}$)-N-carboxymethyl-N-hydroxyethyl imidazolinium betaines, more specifically, 2-decyl-N-carboxymethyl-N-hydroxyethyl imidazolinium betaine, 2-lauryl-N-carboxymethyl-N-hydroxyethyl imidazolinium betaine, 2-myristyl-N-carboxymethyl-N-hydroxyethyl imidazolinium betaine, 2-coconut oil alkyl-N-carboxymethyl-N-hydroxyethyl imidazolinium betaine, and 2-palmityl-N-carboxymethyl-N-hydroxyethyl imidazolinium betaine.

Examples of the aforementioned alkylsulfobetaines include, for example, lauryldimethylsulfobetaine, coconut oil alkyldimethylsulfobetaine, and laurylhydroxysulfobetaine.

Among those betaines, from the standpoint of detergency, the alkyldimethylaminoacetic acid betaines and/or fatty acid amidopropyl betaines are preferably used. Furthermore, from the standpoint of foaming property and cost efficiency, lauryldimethylaminoacetic acid betaine, coconut oil alkyldimethylaminoacetic acid betaines, lauric acid amidopropyl betaine, and coconut oil fatty acid amidopropyl betaine are preferably used.

The compounded quantity of the (E) component in the present composition is preferably set within a range of 0.1-10 wt. %. If this quantity is less than 0.1 wt. %, the improvement effect of the repeated adhesion prevention ability is poor. If this quantity exceeds 10 wt. %, the composition become slimy and cost efficiency sometimes decreases. From the standpoint of repeated adhesion prevention ability, the range of 1-8 wt. % is preferred, and from the standpoint of cost efficiency, the range of 1-5 wt. % is even more preferred.

The concentrated neutral detergent composition in accordance with the present invention contains the above-described (A)-(C) components as necessary surfactant component. In addition it can be appropriately compounded with the above-described (E) component and well-known surfactant components other than the (A)-(C) and (E) components. The sum of the (A)-(C) components as necessary surfactant components has to be set to 30-70 wt. %. Thus, when the surfactant concentration is less than 30 wt. %, no significant difference in concentration is observed with the conventional products and the container cannot be made more compact. Conversely, when the surfactant concentration is above 70 wt. %, the product has poor stability in storage. From the standpoint of detergency and stability in storage, it is preferred that the concentration of all the surfactants in the composition be set to 30-65 wt. %.

Further, in the concentrated neutral detergent composition of the present invention, from the viewpoint of the balance of detergency, repeated-adhesion prevention, and storage stability, it is preferable to set the mass ratio [(A)/{(A)+(B)+(C)}] to 0.001 to 0.2, more preferably to 0.02 to 0.16, and set the mass ratio [(C)/{(A)+(B)+(C)}] to 0.2 to 0.76, more preferably to 0.4 to 0.75.

The pH of the starting liquids for the concentrated neutral detergent composition in accordance with the present invention is adjusted to a range of 6-8 so that the composition can be used for manual washing. If necessary, the pH adjustment is conducted by adding an appropriate amount of substances demonstrating alkaline property and substances demonstrating acidic property. The "appropriate amount" means an amount allowing the pH of the starting liquids for the composition to be adjusted to the desired value.

Examples of substances demonstrating alkaline property include alkali metal hydroxides such as sodium hydroxide, and potassium hydroxide, carbonates such as sodium carbonate, sodium bicarbonate, and potassium carbonate, silicates such as sodium silicate and potassium silicate, borates such as sodium borate, organic acid salts such as sodium citrate, amines such as monoethanolamine and diethanolamine, and ammonia. Examples of substances that demonstrate acidic property and used for pH adjustment include inorganic acids such as hydrochloric acid and sulfuric acid and organic acids such as citric acid and acetic acid.

A thickening agent or diluting agent is preferably used to adjust the consistency of the starting liquids for the concentrated neutral detergent composition in accordance with the present invention so that the viscosity thereof at a temperature of 25° C. (based on JIS Z 8803 "Methods for Measuring Viscosity with Rotary Viscometer of Single Cylinder Type) is with a range of 100-1000 mpa-s. Adjusting the viscosity to this range makes it possible to avoid excess usage of the detergent during dilution.

If desired, the concentrated neutral detergent composition in accordance with the present invention can also contain various components such as waste softeners such as nitrilotriacetic acid, ethylenediaminetetracetic acid, citric acid, and salts thereof, moisture retaining agents, pH buffers, bactericidal agents, corrosion inhibitors, mold inhibitors, antioxidants, perfumes, dyes, hydrotropic acid and surfactants that are not equivalent to the above-described (A)-(C) and (E) components such as aminoxide within ranges causing no degradation of the effect of the present invention.

Further, if desired, the concentrated neutral detergent composition in accordance with the present invention can contain a water-soluble solvent such as a lower alcohol, propylene glycol, and polyethylene glycol, but the concentrated neutral detergent composition in accordance with the present invention can demonstrate good stability in storage even when it contains no water-soluble solvent.

The concentrated neutral detergent composition in accordance with the present invention can be used for manually washing hard surfaces, in particular, it can be advantageously used for washing tableware and kitchenware, for example, in kitchens of groceries, school cafeteria, hotels, restaurants, dining rooms of companies, and also industrial sites such as food processing plants and kitchens of homes. The washing is usually conducted by diluting the starting liquid, for example, in a sink, at a ratio of 2-1000 to prepare an aqueous solution of detergent, immersing the object to be washed, and manually washing it, or by soaking a sponge or the like in the starting liquid or an aqueous solution of the detergent obtained by diluting the starting liquid at a ratio of 2-10 and then manually washing with the sponge.

Further, the concentrated neutral detergent composition in accordance with the present invention can be also advantageously used for washing hard surfaces such as floors, walls, production stands, and shelves in the above-described kitchens and industrial sites.

The concentrated neutral detergent composition in accordance with the present invention will be described below in greater details based on working examples thereof and comparative examples. Incidentally the present invention is not limited to these examples.

The concentrated neutral detergent compositions of Working Examples 1-23 and Comparative Examples 1-10 shown in Tables 1 to 6 described below were prepared and subjected to a variety of tests. The numerical values relating to each component in the table is the content of (wt. %) of the pure fraction of each component. An appropriate quantity of pH adjusting agent was added to each composition and the pH was adjusted so that the pH value of the compositions is 7. The sum total of the components (A)-(E), pH adjusting agent, and other components is 100 wt. %.

Test items relating to detergent capacity, foaming property, ability to prevent repeated adhesion, and stability of storage of each concentrated neutral detergent composition that was obtained were evaluated by the below-described test methods according to the below-described evaluation criteria. The results are shown in Tables 1 to 6 described below.

(1) Detergent Capacity Test

[Test Method]

A contaminant bath was prepared by simultaneously dissolving 20 g of oils and fats containing beef tallow and soybean oil at a volume ratio of 1:1, 0.25 g of monoolein, and 0.1 g of oil red in 60 mL of chloroform. A slide glass having a weight ($W_0$) measured in advance was immersed into the contaminant bath to cause the adhesion of the contaminant. The slide glass was air flow dried, the weight ($W_1$) thereof was measured, and the slide glass was used as a test piece. Then, 300 mL of dilute solutions were prepared by 1000-fold dilution of each composition by using tap water, and the dilute solutions were stirred by using a stirrer. A total of four test pieces were immersed in the stirred solutions, removed therefrom in 2 min, rinsed with water, and air flow dried overnight. Then the weight ($W_2$) thereof was measured. The washing ratio was calculated by the following formula, an average value of the washing ratio for four samples was found, and the evaluation was conducted based on the following criteria.

$$\text{Washing ratio (\%)}=\{1-((W_2-W_0)/(W_1-W_0))\}\times 100,$$

$W_0$: weight of the slide glass, $W_1$: weight of the testpiece after adhesion of contaminant, $W_2$: weight of the testpiece after washing.

[Evaluation Criteria]

⊕: washing ratio is 90% or more,

○: washing ratio is 75% or more and less than 90%,

Δ: washing ratio is 60% or more and less than 75%,

X: washing ratio is less than 60%.

(2) Foaming Property Test

[Test Method]

A total of 30 mL of a dilute solution prepared by 1000-fold dilution of each composition by using tap water and 5 mL of salad oil were introduced into a 100 mL measuring cylinder equipped with a common plug and having a capacity of 100 mL and shaken 20 times up and down with a frequency of 1 cycle per 1 sec. The quantity of foam immediately after completion of shaking was measured. The evaluation was conducted based on the following criteria.

[Evaluation Criteria]

⊕: quantity of foam is 50 mL or more,

○: quantity of foam is 35 mL or more and less than 50 mL,

Δ: quantity of foam is 20 mL or more and less than 35 mL,

X: quantity of foam is less than 20 mL.

(3) Test for Ability to Prevent Repeated Adhesion

[Test Method]

A total of 10 g of a dilute solution obtained by 100-fold dilution of each composition with tap water and 4 mL of salad oil colored with oil red were introduced into a test tube and stirred for 10 sec using a homogenizer to emulsify the salad oil. A polypropylene testpiece (2.5×3.8 cm) was immersed for 5 sec into the test tube in 5 min after completion of stirring, removed therefrom, and rinsed with water. The testpiece was visually observed and evaluated according to the following criteria.

[Evaluation Criteria]

⊕: testpiece remains white (repeated adhesion of salad oil was not observed),

○: testpiece is locally lightly red (slight repeated adhesion of salad oil was observed), Δ: testpiece is lightly red over the entire surface (repeated adhesion of salad oil was observed), X: testpiece is deeply red over the entire surface (intensive repeated adhesion of salad oil was observed).

(4) Test 1 on Stability in Storage: Freeze Recoverability

[Test Method]

Each composition was frozen by keeping for 1 day in a freezer (manufactured by Hoshizaki K. K., model HRF-90P) set to −15° C. and then thawed at room temperature. Such cycles were repeated 5 times and the state of each composition in 8 h after the beginning of thawing was visually observed. The evaluation was conducted according to the following criteria.

[Evaluation Criteria]

⊕: no precipitation, discoloration, or separation was observed in the composition after 5 cycles of freezing/thawing.

○: no precipitation, discoloration, or separation was observed in the composition after 4 cycles of freezing/thawing, but precipitation, discoloration, and separation were observed in the fifth cycle.

Δ: no precipitation, discoloration, or separation was observed in the composition after 3 cycles of freezing/thawing, but precipitation, discoloration, and separation were observed in the fourth cycle.

X: precipitation, discoloration, and separation were observed before 3 cycles of freezing/thawing.

(5) Test 2 on Stability in Storage: Freeze Recoverability

[Test Method]

Each composition was allowed to stay for 3 months in an incubator (manufactured by Yamato Kagaku K. K., model IS82) set to 5° C. and the presence or absence of precipitation, discoloration, and separation were visually observed. The evaluation was conducted according to the following criteria.

[Evaluation Criteria]

⊕: absolutely no precipitation, discoloration, or separation was observed in the composition.

○: slight precipitation, discoloration, and separation was observed in the composition.

Δ: clear precipitation, discoloration, and separation was observed in the composition.

X: intense precipitation, discoloration, and separation were observed in the composition.

(6) Test 3 on Stability in Storage: Freeze Recoverability

[Test Method]

Each composition was allowed to stay for 3 months in a thermostat set to 50° C. and the presence or absence of precipitation, discoloration, and separation were visually observed. The evaluation was conducted according to the following criteria.

[Evaluation Criteria]

⊕: absolutely no precipitation, discoloration, or separation was observed in the composition.

○: slight precipitation, discoloration, and separation was observed in the composition.

Δ: clear precipitation, discoloration, and separation was observed in the composition.

X: intense precipitation, discoloration, and separation were observed in the composition.

The components shown in Tables 1 to 6 below are described hereinbelow in greater detail.

SAS secondary alkanesulfonic acid sodium salt wherein m+n=10−14 and M is a sodium ion in Formula (1 above)

(manufactured by Clariant Corp., trade name Hostapur SAS93)

Alkyl ether 1 ethylene oxide propylene oxide adduct of straight-chain alcohol containing 10 carbon atoms (manufactured by Daiichi Kogyo Seiyaku K. K., trade name Noigen XL80).

Alkyl ether 2 ethylene oxide 6 mole adduct of straight-chain alcohol containing 11 carbon atoms (sample product)

Alkyl ether 3 ethylene oxide 8 mole adduct of straight-chain alcohol containing 9-11 carbon atoms (manufactured by Shell Japan Co., Ltd., trade name Neodol 91-8T).

Alkyl ether 4 ethylene oxide 9 mole adduct of straight-chain alcohol containing 12 carbon atoms (manufactured by Daiichi Kogyo Seiyaku K. K., trade name DKS NO-90).

Alkyl ether 5 ethylene oxide 8.1 mole—propylene oxide 2.1 mole adduct of straight-chain alcohol containing 12-14 carbon atoms (manufactured by Daiichi Kogyo Seiyaku K. K., trade name Noigen LP-100)

Alkyl ether 6 ethylene oxide 8 mole adduct of oxoalcohol containing 13 carbon atoms (manufactured by BASF Corp., trade name Lutensol TO8).

Alkyl ether 7 ethylene oxide propylene oxide adduct of straight-chain alcohol containing 14-15 carbon atoms (manufactured by Sanyo Chemical Industries Co., Ltd., trade name Naroacty HN-95).

Alkyl ether 8 ethylene oxide 11 mole adduct of straight-chain alcohol containing 16-18 carbon atoms (manufactured by BASF Corp., trade name Lutensol AT11).

Alkyl ether 9 ethylene oxide 9 mole adduct of secondary alcohol containing 12-15 carbon atoms (manufactured by Nippon Shokubai Co., Ltd., trade name Softanol SS90).

APG 1 alkyl polyglucoside wherein $R^1$=10, $x$=0, $y$=1.4, and Z is a glucose residue in formula (2) above (manufactured by Cognis Japan Co., Ltd., trade name Plantacare 2000UP).

APG 2 alkyl polyglucoside wherein $R^1$=10, $x$=0, $y$=1−1.4, and Z is a glugose residue in formula (2) above (manufactured by Kao Corp., trade name Mydol 10).

Betaine 1 lauryldimethylaminoacetic acid betaine (manufactured by Cognis Japan Co., Ltd., trade name DEHYTON AB30).

Betaine 2 lauric acid amidopropyl betaine (manufactured by Clariant Co., Ltd., trade name GENEGEN DAB-J).

Amine oxide 1 alkyldimethylamine oxide (manufactured by Lonza Inc., trade name Barlox 12).

Amine oxide 2 laurylamidopropyldimethylamine oxide (manufactured by Kawaken Fine Chemicals Co., Ltd., trade name Softazoline LAO).

TABLE 1

| | | WORKING EXAMPLES | | | | | |
|---|---|---|---|---|---|---|---|
| | | 1 | 2 | 3 | 4 | 5 | 6 |
| A | SAS | 5.0 | 3.0 | 8.0 | 3.0 | 5.0 | 1.0 |
| B | ALKYL ETHER 1 | 10.0 | 10.0 | 2.0 | | 10.0 | 12.0 |
| | ALKYL ETHER 2 | 5.0 | 5.0 | 10.0 | 10.0 | 10.0 | |
| | ALKYL ETHER 3 | | 2.0 | | | | |
| | ALKYL ETHER 4 | | | | | | |
| | ALKYL ETHER 5 | | | | 10.0 | | |
| | ALKYL ETHER 6 | | | | | | |
| | ALKYL ETHER 7 | | | | | | |
| | ALKYL ETHER 8 | | | | 5.0 | | |
| | ALKYL ETHER 9 | | | | | | |
| C | APG 1 | 10.0 | 15.0 | 20.0 | 10.0 | 25.0 | 40.0 |
| | APG 2 | | | 2.0 | 10.0 | | |
| D | ION EXCHANGE WATER | BALANCE | BALANCE | BALANCE | BALANCE | BALANCE | BALANCE |
| PH ADJUSTING AGENT (CITRIC ACID) | | APPROPR. AMOUNT | APPROPR. AMOUNT | APPROPR. AMOUNT | APPROPR. AMOUNT | APPROPR. AMOUNT | APPROPR. AMOUNT |
| PH ADJUSTING AGENT (DIETHANOLAMINE) | | | | | | | |
| TOTAL AMOUNT OF SURFACTANTS | | 30.0 | 35.0 | 42.0 | 48.0 | 50.0 | 53.0 |
| EVALUATION | DETERGENT CAPACITY | ○ | ⊕ | ⊕ | ⊕ | ⊕ | ⊕ |
| | FOAMING PROPERTY | ○ | ⊕ | ⊕ | ⊕ | ⊕ | ⊕ |
| | PREVENTION OF REPEATED ADHESION | ○ | ⊕ | ⊕ | ⊕ | ⊕ | ⊕ |
| | STABILITY IN STORAGE 1 (FREEZING) | ⊕ | ⊕ | ⊕ | ⊕ | ⊕ | ⊕ |
| | STABILITY IN STORAGE 2 (LOW TEMPERATURE) | ⊕ | ⊕ | ⊕ | ⊕ | ⊕ | ⊕ |
| | STABILITY IN STORAGE 3 (HIGH TEMPERATURE) | ⊕ | ⊕ | ⊕ | ⊕ | ⊕ | ⊕ |

TABLE 2

| | | WORKING EXAMPLES | | | | | |
|---|---|---|---|---|---|---|---|
| | | 7 | 8 | 9 | 10 | 11 | 12 |
| A | SAS | 10.0 | 5.0 | 1.0 | 10.0 | 5.0 | 0.1 |
| B | ALKYL ETHER 1 | 10.0 | 10.0 | | | | 20.0 |
| | ALKYL ETHER 2 | | 10.0 | 20.0 | 10.0 | | |
| | ALKYL ETHER 3 | 10.0 | | | 10.0 | 20.0 | |
| | ALKYL ETHER 4 | | | | | | |
| | ALKYL ETHER 5 | | | 10.0 | 10.0 | | |
| | ALKYL ETHER 6 | 10.0 | | | | | 20.0 |
| | ALKYL ETHER 7 | | | | | 20.0 | |
| | ALKYL ETHER 8 | | | | | | |
| | ALKYL ETHER 9 | 5.0 | | | | | |
| C | APG 1 | | 20.0 | | 25.0 | 10.0 | 29.9 |
| | APG 2 | 15.0 | 15.0 | 30.0 | | 10.0 | |
| D | ION EXCHANGE WATER | BALANCE | BALANCE | BALANCE | BALANCE | BALANCE | BALANCE |
| PH ADJUSTING AGENT (CITRIC ACID) | | APPROPR. AMOUNT | APPROPR. AMOUNT | APPROPR. AMOUNT | APPROPR. AMOUNT | APPROPR. AMOUNT | APPROPR. AMOUNT |
| PH ADJUSTING AGENT (DIETHANOLAMINE) | | | | | | | |
| TOTAL AMOUNT OF SURFACTANTS | | 60.0 | 60.0 | 61.0 | 65.0 | 65.0 | 70.0 |
| EVALUATION | DETERGENT CAPACITY | ⊕ | ⊕ | ⊕ | ⊕ | ⊕ | ○ |
| | FOAMING PROPERTY | ⊕ | ⊕ | ⊕ | ⊕ | ⊕ | ⊕ |

TABLE 2-continued

| | | WORKING EXAMPLES | | | | | |
|---|---|---|---|---|---|---|---|
| | | 7 | 8 | 9 | 10 | 11 | 12 |
| | PREVENTION OF REPEATED ADHESION | ⊕ | ⊕ | ⊕ | ⊕ | ○ | ○ |
| | STABILITY IN STORAGE 1 (FREEZING) | ⊕ | ⊕ | ⊕ | ⊕ | ○ | ○ |
| | STABILITY IN STORAGE 2 (LOW TEMPERATURE) | ⊕ | ⊕ | ⊕ | ⊕ | ○ | ○ |
| | STABILITY IN STORAGE 3 (HIGH TEMPERATURE) | ⊕ | ⊕ | ⊕ | ⊕ | ○ | ○ |

TABLE 3

| | | WORKING EXAMPLES | | | | | |
|---|---|---|---|---|---|---|---|
| | | 13 | 14 | 15 | 16 | 17 | 18 |
| A | SAS | 14.0 | 0.1 | 10.0 | 8.0 | 1.0 | 5.0 |
| B | ALKYL ETHER 1 | | | 10.0 | 10.0 | | 10.0 |
| | ALKYL ETHER 2 | | | | 10.0 | | 10.0 |
| | ALKYL ETHER 3 | | 25.0 | 10.0 | | | |
| | ALKYL ETHER 4 | | | | | 10.0 | |
| | ALKYL ETHER 5 | | | 10.0 | | | |
| | ALKYL ETHER 6 | | | | | | |
| | ALKYL ETHER 7 | 31.0 | | | | 10.0 | |
| | ALKYL ETHER 8 | | 5.0 | | | | |
| | ALKYL ETHER 9 | | | | | | |
| C | APG 1 | 25.0 | 20.0 | | 10.0 | 30.0 | 25.0 |
| | APG 2 | | | 20.0 | 15.0 | | |
| E | BETAINE 1 | | | | 2.0 | | |
| | BETAINE 2 | | 5.0 | 0.1 | | 3.0 | 3.0 |
| D | ION EXCHANGE WATER | BALANCE | BALANCE | BALANCE | BALANCE | BALANCE | BALANCE |
| PH ADJUSTING AGENT (CITRIC ACID) | | APPROPR. AMOUNT | APPROPR. AMOUNT | APPROPR. AMOUNT | APPROPR. AMOUNT | APPROPR. AMOUNT | APPROPR. AMOUNT |
| PH ADJUSTING AGENT (DIETHANOLAMINE) | | | | | | | |
| TOTAL AMOUNT OF SURFACTANTS | | 70.0 | 55.1 | 60.1 | 55.0 | 54.0 | 53.0 |
| EVALUATION | DETERGENT CAPACITY | ⊕ | ⊕ | ⊕ | ⊕ | ⊕ | ⊕ |
| | FOAMING PROPERTY | ⊕ | ⊕ | ⊕ | ⊕ | ⊕ | ⊕ |
| | PREVENTION OF REPEATED ADHESION | ⊕ | ○ | ⊕ | ⊕ | ⊕ | ⊕ |
| | STABILITY IN STORAGE 1 (FREEZING) | ○ | ⊕ | ⊕ | ⊕ | ⊕ | ⊕ |
| | STABILITY IN STORAGE 2 (LOW TEMPERATURE) | ○ | ⊕ | ⊕ | ⊕ | ⊕ | ⊕ |
| | STABILITY IN STORAGE 3 (HIGH TEMPERATURE) | ○ | ⊕ | ⊕ | ⊕ | ⊕ | ⊕ |

TABLE 4

| | | WORKING EXAMPLES | | | | |
|---|---|---|---|---|---|---|
| | | 19 | 20 | 21 | 22 | 23 |
| A | SAS | 5.0 | 5.0 | 5.0 | 8.0 | 5.0 |
| B | ALKYL ETHER 1 | | 10.0 | 10.0 | | |
| | ALKYL ETHER 2 | | 5.0 | 5.0 | 30.0 | |
| | ALKYL ETHER 3 | | | | | |
| | ALKYL ETHER 4 | | | | | 12.0 |
| | ALKYL ETHER 5 | | | | | |
| | ALKYL ETHER 6 | 15.0 | | | | |
| | ALKYL ETHER 7 | | | | | |
| | ALKYL ETHER 8 | | | | | |
| | ALKYL ETHER 9 | | | 5.0 | | |
| C | APG 1 | | 10.0 | 25.0 | | 10.0 |
| | APG 2 | 20.0 | 5.0 | | 10.0 | 3.0 |
| E | BETAINE 1 | 1.0 | 5.0 | | | |
| | BETAINE 2 | | 5.0 | 3.0 | 8.0 | 10.0 |
| | AMINE OXIDE 1 | | | 1.0 | | |
| | AMINE OXIDE 2 | | | | 5.0 | 3.0 |
| D | ION EXCHANGE WATER | BALANCE | BALANCE | BALANCE | BALANCE | BALANCE |
| PH ADJUSTING AGENT (CITRIC ACID) | | APPROPR. AMOUNT | APPROPR. AMOUNT | APPROPR. AMOUNT | APPROPR. AMOUNT | APPROPR. AMOUNT |

TABLE 4-continued

| | | WORKING EXAMPLES | | | | |
|---|---|---|---|---|---|---|
| | | 19 | 20 | 21 | 22 | 23 |
| PH ADJUSTING AGENT (DIETHANOLAMINE) | | | | | | |
| TOTAL AMOUNT OF SURFACTANTS | | 41.0 | 45.0 | 54.0 | 61.0 | 43.0 |
| EVALUATION | DETERGENT CAPACITY | ⊕ | ⊕ | ⊕ | ⊕ | ○ |
| | FOAMING PROPERTY | ⊕ | ⊕ | ⊕ | ⊕ | ⊕ |
| | PREVENTION OF REPEATED ADHESION | ⊕ | ⊕ | ⊕ | ⊕ | ⊕ |
| | STABILITY IN STORAGE 1 (FREEZING) | ⊕ | ⊕ | ⊕ | ⊕ | ⊕ |
| | STABILITY IN STORAGE 2 (LOW TEMPERATURE) | ⊕ | ⊕ | ⊕ | ⊕ | ⊕ |
| | STABILITY IN STORAGE 3 (HIGH TEMPERATURE) | ⊕ | ⊕ | ⊕ | ⊕ | ⊕ |

TABLE 5

| | | COMPARATIVE EXAMPLES | | | | |
|---|---|---|---|---|---|---|
| | | 1 | 2 | 3 | 4 | 5 |
| A | SAS | | 10.0 | 10.0 | 5.0 | 5.0 |
| B | ALKYL ETHER 1 | 20.0 | | | | |
| | ALKYL ETHER 2 | | | | 15.0 | |
| | ALKYL ETHER 3 | | | | | 30.0 |
| | ALKYL ETHER 4 | | | 8.0 | | |
| | ALKYL ETHER 5 | | | | 25.0 | |
| | ALKYL ETHER 6 | | | | | |
| | ALKYL ETHER 7 | | | | | |
| | ALKYL ETHER 8 | | | | | |
| | ALKYL ETHER 9 | | | | | |
| C | APG 1 | 20.0 | | 30.0 | | 5.0 |
| | APG 2 | | 30.0 | | | |
| E | BETAINE 1 | | | | | |
| | BETAINE 2 | | | | | |
| D | ION EXCHANGE WATER | BALANCE | BALANCE | BALANCE | BALANCE | BALANCE |
| PH ADJUSTING AGENT (CITRIC ACID) | | APPROPR. AMOUNT | APPROPR. AMOUNT | APPROPR. AMOUNT | APPROPR. AMOUNT | APPROPR. AMOUNT |
| PH ADJUSTING AGENT (DIETHANOLAMINE) | | | | | | |
| TOTAL AMOUNT OF SURFACTANTS | | 40.0 | 40.0 | 48.0 | 45.0 | 40.0 |
| EVALUATION | DETERGENT CAPACITY | ○ | X | Δ | Δ | ⊕ |
| | FOAMING PROPERTY | X | Δ | ○ | X | Δ |
| | PREVENTION OF REPEATED ADHESION | X | ⊕ | ⊕ | X | Δ |
| | STABILITY IN STORAGE 1 (FREEZING) | ⊕ | ⊕ | ⊕ | ⊕ | ⊕ |
| | STABILITY IN STORAGE 2 (LOW TEMPERATURE) | ⊕ | ⊕ | ⊕ | ⊕ | ⊕ |
| | STABILITY IN STORAGE 3 (HIGH TEMPERATURE) | ⊕ | ⊕ | ⊕ | ⊕ | ⊕ |

TABLE 6

| | | COMPARATIVE EXAMPLES | | | | |
|---|---|---|---|---|---|---|
| | | 6 | 7 | 8 | 9 | 10 |
| A | SAS | 6.0 | 20.0 | 5.0 | 5.0 | 14.0 |
| B | ALKYL ETHER 1 | | | 25.0 | | 10.0 |
| | ALKYL ETHER 2 | | 10.0 | 25.0 | | |
| | ALKYL ETHER 3 | 20.0 | | | | |
| | ALKYL ETHER 4 | 20.0 | | | | |
| | ALKYL ETHER 5 | | | | 30.0 | 20.0 |
| | ALKYL ETHER 6 | | 10.0 | | 30.0 | 10.0 |
| | ALKYL ETHER 7 | | | | | |
| | ALKYL ETHER 8 | | | | | |
| | ALKYL ETHER 9 | | | | | |
| C | APG 1 | 4.0 | | 15.0 | 15.0 | 22.5 |
| | APG 2 | | 20.0 | | | |
| E | BETAINE 1 | | | | | |
| | BETAINE 2 | | | | | |
| D | ION EXCHANGE WATER | BALANCE | BALANCE | BALANCE | BALANCE | BALANCE |
| PH ADJUSTING AGENT (CITRIC ACID) | | APPROPR. AMOUNT | APPROPR. AMOUNT | APPROPR. AMOUNT | APPROPR. AMOUNT | APPROPR. AMOUNT |
| PH ADJUSTING AGENT (DIETHANOLAMINE) | | | | | | |
| TOTAL AMOUNT OF SURFACTANTS | | 50.0 | 60.0 | 70.0 | 80.0 | 76.5 |
| EVALUATION | DETERGENT CAPACITY | ⊕ | ⊕ | ⊕ | ⊕ | ⊕ |
| | FOAMING PROPERTY | ○ | ⊕ | ⊕ | ⊕ | ⊕ |
| | PREVENTION OF REPEATED ADHESION | X | ⊕ | Δ | Δ | ○ |
| | STABILITY IN STORAGE 1 (FREEZING) | ○ | X | X | X | X |

TABLE 6-continued

| | COMPARATIVE EXAMPLES | | | | |
|---|---|---|---|---|---|
| | 6 | 7 | 8 | 9 | 10 |
| STABILITY IN STORAGE 2 (LOW TEMPERATURE) | ○ | X | X | X | X |
| STABILITY IN STORAGE 3 (HIGH TEMPERATURE) | ○ | X | X | X | X |

The results present in Tables 1 to 6 demonstrate that the products of Working Examples 1 to 23 have good performance in terms of detergency, foaming property, ability to prevent repeated adhesion of contaminants, and stability in storage.

On the other hand, the products of Comparative Examples 1 to 6 are prepared by removing the (A) component, (B) component, or (C) components from the concentrated neutral detergent composition in accordance with the present invention or by using too small amounts of those components and each of those products has poor detergency, foaming property, or ability to prevent repeated adhesion of contaminants. Furthermore, the product of Comparative Example 7 in which the (A) component was compounded in excess has poor stability in storage, and the products of Comparative Examples 8 and 9 in which the (B) component was compounded in excess have poor ability to prevent repeated adhesion of contaminants and stability in storage. Further, the products of Comparative Examples 9 and 10 in which the total content of surfactants having the (A) to (C) components as the necessary components was in excess of 70 wt. % have poor stability in storage.

The invention claimed is:

1. A concentrated neutral detergent composition, characterized in comprising:

(A) 0.1 to 14 wt % of an alkanesulfonic acid salt;

(B) 12 to 40 wt % a polyoxyalkylene alkyl ether;

(C) 20 to 40 wt % an alkyl polyglucoside; and (D) water.

2. The concentrated neutral detergent composition according to claim 1, further comprising (B) 0.1 to 10 wt % of a betaine.

3. The concentrated neutral detergent composition according to claim 1, wherein the sum total of surfactant components including said (A) to (C) components as necessary components is 30 to 70 wt % based on the entire composition.

4. The concentrated neutral detergent composition according to claim 1, wherein the alkanesulfonic acid salt which is said (A) component is a secondary alkanesulfonic acid salt represented by the general formula (1) hereinbelow:

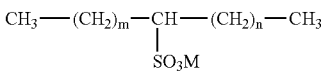

$$CH_3-(CH_2)_m-\underset{\underset{SO_3M}{|}}{CH}-(CH_2)_n-CH_3 \quad (1)$$

where M denotes a hydrogen ion, an alkali metal ion, an alkaline earth metal ion equivalent to monovalent, an ammonium ion that may be substituted, and an alkanolamine ion; where m+n=7 to 17.

5. The concentrated neutral detergent composition according to claim 1, wherein the polyoxyalkylene alkyl ether which is said (B) component is a polyoxyethylene alkyl ether and/or polyoxyethylene polyoxypropylene alkyl ether.

6. The concentrated neutral detergent composition according to claim 1, wherein the alkyl polyglucoside which is said (C) component is represented by the general formula (2) hereinbelow:

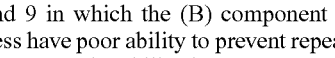

$$R^1-(OR^2)_x(Z)_y \quad (2)$$

where $R^1$ denotes a linear or branched alkyl group, alkenyl group, or alkyiphenyl group with an average number of carbon atoms of 8 to 18, $R^2$ denotes an alkylene group with 2 to 4 carbon atoms, Z denotes a residue derived from a reduced sugar with 5 to 6 carbon atoms, x is a number with an average thereof being 0 to 5, and y is a value with an average thereof being 1 to 2.

7. The concentrated neutral detergent composition according to claim 2, wherein the betaine which is said (E) component is alkyldimethylaminoacetic acid betaine and/or fatty acid amidopropyl betaine.

8. The concentrated neutral detergent composition according to claim 1, supplied for hard surface applications.

9. The concentrated neutral detergent composition according to claim 1, supplied for tableware and cooking utensil applications.

10. The concentrated neutral detergent composition according to claim 1 comprising greater than 20 to 40 wt % of a polyoxyalkylene alkyl ether.

11. A concentrated neutral detergent composition, characterized in comprising:

(A) 0.1 to 14 wt % of an alkanesulfonic acid salt;

(B) 12 to 40 wt % a polyoxyalkylene alkyl ether;

(C) 22 to 40 wt % an alkyl polyglucoside; and (D) water.

12. The concentrated neutral detergent composition according to claim 11 comprising greater than 20 to 40 wt % of a polyoxyalkylene alkyl ether.

13. The concentrated neutral detergent composition according to claim 1 comprising greater than 25 to 40 wt % an alkyl polyglucoside.

14. The concentrated neutral detergent composition according to claim 1 comprising greater than 30 to 40 wt % an alkyl polyglucoside.

15. The concentrated neutral detergent composition according to claim 1 comprising greater than 30 to 40 wt % of a polyoxyalkylene alkyl ether.

* * * * *